US005334051A

United States Patent [19]

Devine et al.

[11] Patent Number: 5,334,051

[45] Date of Patent: Aug. 2, 1994

[54] CONNECTOR FOR COAXIAL CABLE HAVING CORRUGATED OUTER CONDUCTOR AND METHOD OF ATTACHMENT

[75] Inventors: Edward B. Devine, Calumet City; Richard W. Smith, Orland Park, both of Ill.

[73] Assignee: Andrew Corporation, Orland Park, Ill.

[21] Appl. No.: 78,621

[22] Filed: Jun. 17, 1993

[51] Int. Cl.[5] ..... H01R 17/04

[52] U.S. Cl. ..... 439/583

[58] Field of Search ..... 439/578–585

[56] References Cited

U.S. PATENT DOCUMENTS

| | | | |
|---|---|---|---|
| 3,199,061 | 8/1965 | Johnson et al. | 439/429 |
| 3,291,895 | 12/1966 | Van Dyke | 174/88 |
| 4,046,451 | 9/1977 | Juds et al. | 439/583 |
| 5,137,470 | 8/1992 | Doles | 439/578 |
| 5,154,636 | 10/1992 | Vaccaro et al. | 439/583 |
| 5,167,533 | 12/1992 | Rauwolf | 439/583 |

*Primary Examiner*—Gary F. Paumen

*Attorney, Agent, or Firm*—Arnold, White & Durkee

[57] ABSTRACT

A connector assembly for a coaxial cable with an inner conductor and a corrugated outer conductor. The connector assembly comprises a center connector adapted to engage the end of the inner conductor of the coaxial cable, a dielectric spacer around the inner connector, an outer connector in the form of a hollow cylinder with a thick central portion for supporting a coupling nut, and thin end portions which form a pair of barrels projecting from opposite ends of the central portion. One of the barrels has a threaded inside surface for threadingly engaging the corrugated outer surface of the outer conductor of the cable. The inside wall of the outer connector forms a circumferential shoulder which extends radially inwardly along the end of the corrugated outer conductor of the cable so that when the outer connector is threaded onto the outer conductor, the shoulder is pressed into engagement with the end of the outer conductor to make electrical contact therewith. The thread portion of the barrel is sufficiently thin that it can be crimped into the corrugations of the outer conductor to permanently attach the outer connector to the cable.

6 Claims, 1 Drawing Sheet

CONNECTOR FOR COAXIAL CABLE HAVING CORRUGATED OUTER CONDUCTOR AND METHOD OF ATTACHMENT

FIELD OF THE INVENTION

The present invention relates generally to connectors for coaxial cables, and, more particularly, to an improved connector for coaxial cables having corrugated outer conductors. The invention also relates to methods of attaching such connectors and cables.

BACKGROUND OF THE INVENTION

Connectors for coaxial cable having corrugated outer conductors are generally used throughout the semi-flexible coaxial cable industry. For example, Rauwolf U.S. Pat. No. 5,167,533 describes a connector for coaxial cables having hollow inner conductors. Vaccaro et al. U.S. Pat. No. 5,154,636 describes a connector for coaxial cables having helically corrugated outer conductors. Doles U.S. Pat. No. 5,137,470 describes a connector for coaxial cables having helically corrugated inner conductors. Juds et al. U.S. Pat. No. 4,046,451 describes a connector for coaxial cables having annularly corrugated outer conductors and plain cylindrical inner conductors. Van Dyke U.S. Pat. No. 3,291,895 describes a connector for cables having helically corrugated inner and outer conductors. A connector for a coaxial cable having a helically corrugated outer conductor and a plain cylindrical inner conductor is described in Johnson et al. U.S. Pat. No. 3,199,061.

SUMMARY OF THE INVENTION

It is a primary object of the invention is to provide an improved coaxial cable connector which can be installed more easily and quickly than previous connectors. A related object is to provide such an improved connector that is self-locating as it is applied to the end of a coaxial cable, and which can be easily applied by hand in preparation for permanent attachment.

A further object of the present invention to provide an improved coaxial cable connector which has fewer parts than previous connectors. A related object of the invention is to provide such an improved connector which minimizes tolerance stack-ups by reducing the number of parts required.

It is another object of the invention to provide such an improved connector which can be efficiently and economically manufactured at a lower cost than previous connectors.

Still another object of this invention is to provide an improved method of permanently attaching a connector to a coaxial cable, so that good electrical contact is maintained between the connector and the cable over a long operating life. A related object is to provide an improved connector which is especially adapted for use in the improved method of attachment.

Other objects and advantages of the invention will be apparent from the following detailed description and the accompanying drawings.

In accordance with the present invention, the foregoing objectives are realized by providing a connector assembly for a coaxial cable having a corrugated outer conductor and an inner conductor, the connector assembly including a center connector adapted to engage the end of the inner conductor of the coaxial cable, and an outer connector in the form of a hollow cylinder having a thick central portion for supporting a coupling nut, and thin end portions forming a pair of barrels projecting from opposite ends of the central portion. One of the barrels has a threaded inside surface for threadingly engaging the corrugated outer surface of the outer conductor of the cable. The inside wall of the outer connector forms a circumferential shoulder which extends radially inwardly along the end of the corrugated outer conductor of the cable so that when the outer connector is threaded onto the outer conductor, the shoulder is pressed into engagement with the end of the outer conductor to make electrical contact therewith. A dielectric spacer is located between the inner and outer connectors.

DETAILED DESCRIPTION OF THE PREFERRED EMBODIMENT

Figure 1:
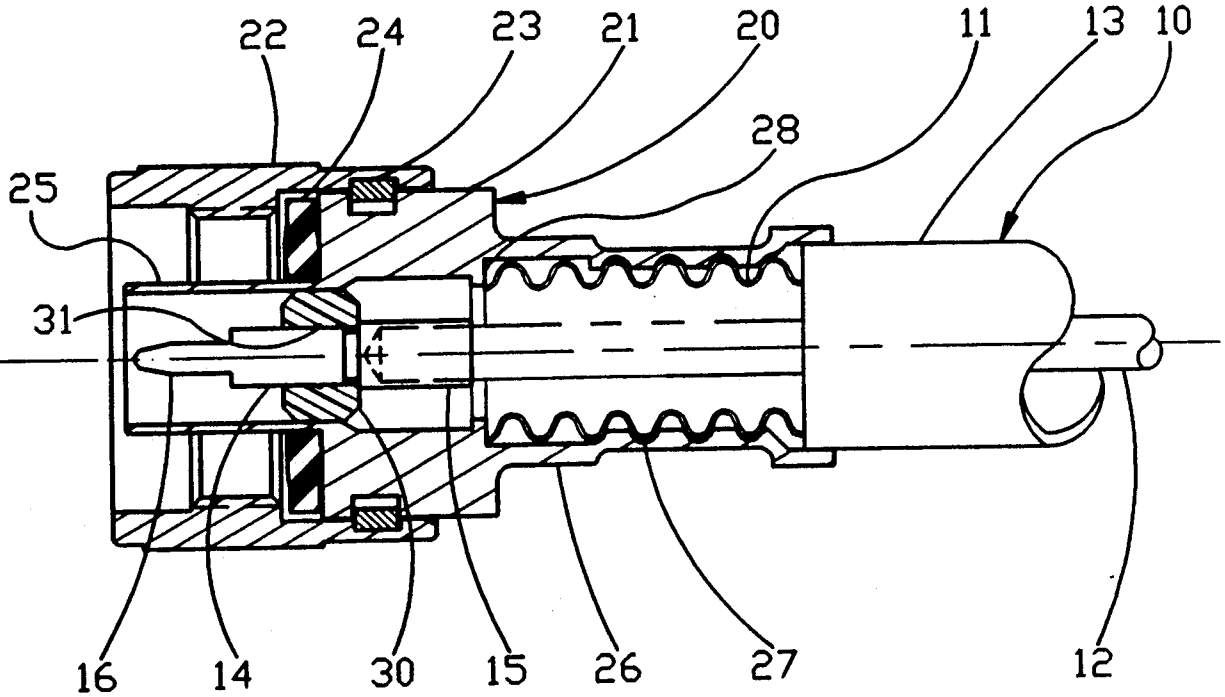
FIG. 1 is a longitudinal sectional view of a connector embodying the present invention, fully assembled on the end of a coaxial cable.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Figure 2:
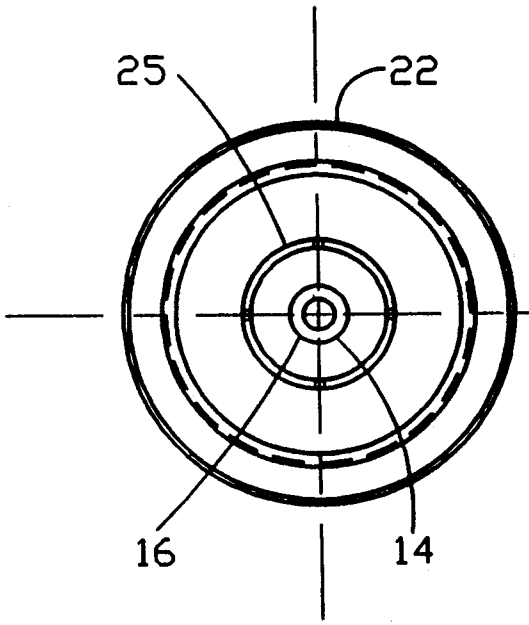
FIG. 2 is an end elevation of the connector shown in FIG. 1.

Turning now to FIGS. 1 and 2, there is shown a connector assembly for a coaxial cable 10 having a helically corrugated outer conductor 11 concentrically spaced from a solid, smooth-walled inner conductor 12 by a dielectric spacer (not shown). As is well known to those familiar with this art, a helically corrugated conductor is distinguished from an annularly corrugated conductor in that the helical corrugations form a continuous pattern of corrugation crests and roots along the length of the cable such that each crest is opposite a root along the circumference of the conductor. Consequently, any transverse cross-section taken through the conductor perpendicular to its axis is radially asymmetrical, which is not true of annularly corrugated conductors.

To prepare the cable 10 for attachment of the connector assembly, the ends of the inner and outer conductors of the cable are cut along two different planes extending perpendicular to the axis of the cable. The cutting plane for the outer conductor 11 and the dielectric of the cable extends through the apex of one of the crests of the corrugations. This exposes the clean flared internal surface of the outer conductor 11. The inner conductor 12 is cut in a plane spaced axially from the cutting plane for the outer conductor 11 so that the inner conductor extends beyond the cut end of the outer conductor. Any burrs or rough edges on the cut ends of the metal conductors 11 and 12 are preferably removed to avoid interference with the connector. The outer surface of the outer conductor 11 is normally covered with a plastic jacket 13 which is trimmed away from the end of the outer conductor 11 along a sufficient length to accommodate the connector assembly.

Electrical contact with the inner conductor 12 of the cable 10 is effected by a conventional inner connector 14, which is attached at its hollow base 15 to the cut end of the inner conductor 12. In the preferred embodiment, the inner connector 14 is secured to the inner conductor 12 by placing electrically conductive solder within the hollow base 15 and telescoping the base over the end of the inner conductor 12. An aperture may be provided in the side wall of the base 16 to permit overflow solder to escape. Alternatively, the base 15 of the inner connector may be attached to the conductor 12 by crimping or electrically conductive adhesive. The head 16 of the inner connector 14 forms a portion of a conventional male connector.

A stepped cylindrical outer connector 20 extends around the cut end of the coaxial cable 10. The central portion 21 of the outer connector 20 is relatively thick to support a coupling nut 22. This coupling nut 22 is secured to the connector 20 by a spring retaining ring 23 which holds the nut 22 captive on the central portion 21 of the connector 20 while permitting free rotation of the nut 22 on the outer connector. A gasket 24 is captured between the nut 22 and the connector 20 to provide an insulated sealing surface for a mating connector.

Projecting from opposite ends of the thick central portion 21 of the outer connector 20 are a pair of barrels 25 and 26 having relatively thin walls. The first barrel 25 extends coaxially along the length of the head 16 of the inner connector 14 to complete the male connector inside the coupling nut 22. The second barrel 26 extends along the outer surface of the outer conductor 11 of the coaxial cable 10. A portion of the inside surface of the barrel 26 is threaded as at 27 to match the helical corrugations of the outer conductor 11. Thus, the outer connector 20 can be easily applied by hand by threading it onto the outer conductor 11 until the connector 20 bottoms out on the cut end of the outer conductor 11. The connector 20 is completely self-locating.

To make electrical connection with the cut end of the outer conductor 11, the inside wall of the outer connector 20 forms a shoulder 28 which extends radially inwardly across the radial depth of the corrugated conductor 11. The innermost diameter of the shoulder 28 is preferably about the same as the minor inside diameter of the outer conductor 11 to ensure maximum contact between the face of the shoulder 28 and the cut end of the outer conductor 11. As the connector 20 is threaded onto the outer conductor 11, the cut end of the conductor 11 is forced against the vertical compression plane formed by the face of the shoulder 28. Consequently, the end portion of the outer conductor 11 is effectively clamped between the shoulder 28 and the threaded surface 27 of the barrel 26.

To permanently attach the outer connector 20 to the outer conductor 11 of the cable, the internally threaded section 27 of the barrel 26 is crimped to deform portions of the barrel 26 into the corrugations of the outer conductor. For example, the threaded section of the barrel 26 may be crimped by means of a conventional open-frame crimp tool equipped with hexagonal crimp dies which convert the circular cross section of the barrel 26 to a hexagonal cross section. In an example where the cylindrical barrel has an outside diameter of 0.430 inch, the barrel may be crimped to a hexagonal shape having an outside dimension of 0.384 inch between diametrically opposed flats. After being crimped in this manner, it is virtually impossible to remove the connector manually, and even with the use of a tool, the connector cannot be removed without permanently damaging the portion of the cable to which the connector has been crimped. This permanent attachment of the connector to the cable ensures the maintenance of good electrical contact between the connector and the cable conductors, thereby ensuring a low VSWR throughout the operating life of the cable connection.

The wall thickness of the threaded section 27 of the barrel 26 must be thin enough to enable it to be crimped. For example, when the outer connector 20 is made of brass, a threaded section 27 having a major wall thickness of 0.095 inch and a minor wall thickness of 0.030 inch can be crimped with a manually operated crimp tool.

To support the inner connector 14 concentrically within the connector assembly, a dielectric sleeve 30 is carried on the inner connector adjacent the base 15. To hold the sleeve 30 in place, a small burr-like rib 31 is formed on the outer surface of the inner connector 14. This rib 31 extends around the circumference of the connector 14 and penetrates into the flexible inner surface of the dielectric sleeve 30 when the sleeve is fitted over the connector 14.

As in most connector assemblies, the shapes and dimensions of the various parts are selected to provide impedance matching between adjoining parts, so that the complete connector and cable assembly has a low VSWR.

We claim:

1. A connector assembly for a coaxial cable having an inner conductor and a corrugated outer conductor, said connector assembly comprising:

an inner connector adapted to engage the end of the inner conductor of the coaxial cable, a unitary outer connector in the form of a hollow cylinder having a thick central portion for supporting a coupling nut, and thin end portions forming a pair of barrels projecting from opposite ends of said central portion, one of said barrels having a threaded inside surface for threadingly engaging the corrugated outer surface of the outer conductor of said cable, the inside wall of said outer connector forming a circumferential shoulder which extends radially inwardly along the end of the corrugated outer conductor of the cable so that when said outer connector is threaded onto said outer conductor, said shoulder is pressed into engagement with the end of said outer conductor to make electrical contact therewith, and a dielectric spacer between said inner and outer connectors.

2. The connector assembly of claim 1 wherein said outer conductor has a major inside diameter at the crests of the corrugations therein and a minor inside diameter at the roots of the corrugations, and said inside diameter of said shoulder is approximately the same as the minor inside diameter of the helically corrugated outer conductor.

3. The connector assembly of claim 1 wherein the portion of said one barrel having said threaded inside surface is sufficiently thin that it can be crimped into the corrugations of said outer conductor to permanently attach said outer connector to said outer conductor.

4. The connector assembly of claim 1 wherein the second barrel of said outer connector extends coaxially along the free end of said inner connector to receive a mating connector.

5. The connector assembly of claim 1 wherein the dielectric spacer encircles the inner connector so as to center it respective to the outer connector.

6. In combination, a connector assembly and a coaxial cable having a helically corrugated outer conductor, the connector assembly comprising:

an inner connector adapted to engage the end of the inner conductor of the coaxial cable, a unitary outer connector having a threaded inner surface to match the helical corrugations of said outer conductor of the coaxial cable so that said outer connector can be threaded onto said helically corrugated outer conductor, said outer connector forming a shoulder having an inside diameter approximately as small as the inside diameter of the helically corrugated outer conductor, for engaging the end of said outer conductor, and a dielectric spacer between said inner and outer connectors.

* * * * *